US009561146B2

(12) United States Patent
Miller

(10) Patent No.: US 9,561,146 B2
(45) Date of Patent: Feb. 7, 2017

(54) UNIVERSAL STAND ASSISTANCE DEVICES, KITS THEREFOR, AND METHODS RELATED THERETO

(71) Applicant: Stander Inc., Logan, UT (US)

(72) Inventor: F. Troy Miller, Logan, UT (US)

(73) Assignee: Stander Inc., Logan, UT (US)

( * ) Notice: Subject to any disclaimer, the term of this patent is extended or adjusted under 35 U.S.C. 154(b) by 27 days.

(21) Appl. No.: 14/178,050

(22) Filed: Feb. 11, 2014

(65) Prior Publication Data

US 2015/0224004 A1 Aug. 13, 2015

(51) Int. Cl.

| | |
|---|---|
| ***A61G 7/053*** | (2006.01) |
| ***A47C 31/00*** | (2006.01) |
| ***A61G 5/14*** | (2006.01) |
| ***A61G 7/10*** | (2006.01) |

(52) U.S. Cl.

CPC ..... *A61G 7/053* (2013.01); *A47C 31/00* (2013.01); *A61G 5/14* (2013.01); *A61G 7/1038* (2013.01)

(58) Field of Classification Search

CPC ..... A61G 7/053; A61G 7/1038; A61G 5/14
USPC ... 135/65, 67; 5/81.1 R, 662, 424, 425, 428, 5/429, 426; 297/411.23; 1/65, 67
See application file for complete search history.

(56) References Cited

U.S. PATENT DOCUMENTS

| | | | | |
|---|---|---|---|---|
| 2,817,387 | A * | 12/1957 | Blake | A61H 3/00 135/67 |
| 3,739,793 | A | 6/1973 | Wilson | |
| 4,248,256 | A * | 2/1981 | Thomas | A61H 3/00 135/67 |
| 4,748,994 | A * | 6/1988 | Schultz | A61H 3/04 135/67 |
| 4,941,495 | A * | 7/1990 | Boyce et al. | 135/65 |
| 4,941,496 | A * | 7/1990 | Berning | 135/67 |
| 4,995,412 | A * | 2/1991 | Hirn | A61H 3/00 135/67 |
| 5,397,169 | A * | 3/1995 | Willans | 297/411.23 |
| 5,435,028 | A | 7/1995 | Frala | |
| 5,465,744 | A | 11/1995 | Browning | |
| D365,314 | S | 12/1995 | Heisinger | |
| 5,983,421 | A | 11/1999 | Walser | |
| 6,134,731 | A * | 10/2000 | Thom et al. | 5/662 |
| 6,138,301 | A * | 10/2000 | Battiston | 5/81.1 R |
| 6,244,285 | B1 | 6/2001 | Gamache | |
| 6,332,232 | B1 | 12/2001 | Neal | |

(Continued)

FOREIGN PATENT DOCUMENTS

GB 2290723 B * 1/1998

OTHER PUBLICATIONS

MTS Medical Supply, Safety Sure Stand Ease, accessed by internet Apr. 23, 2014 at http://www.mtsmedicalsupply.com/SafetySure-StandEase/1522/970.html.

(Continued)

*Primary Examiner* — Noah Chandler Hawk
(74) *Attorney, Agent, or Firm* — Stoel Rives LLP

(57) ABSTRACT

Universal stand assistance devices, kits therefor, and methods related thereto are disclosed herein. The universal stand assistance devices may include an anchor having a first arm and a second arm. A length of each of the first and second arms may be adjustable. The universal stand assistance devices may further include first and second legs. The height of each of the first and second legs may be adjustable. The universal stand assistance devices may further include handles adjustable in height.

23 Claims, 8 Drawing Sheets

(56) References Cited

U.S. PATENT DOCUMENTS

| | | | | |
|---|---|---|---|---|
| 6,401,280 | B1 * | 6/2002 | Baker | 5/662 |
| 6,860,281 | B1 | 3/2005 | Clift | |
| 6,990,990 | B2 * | 1/2006 | Wilensky | A61H 3/00 135/67 |
| 7,028,353 | B2 * | 4/2006 | Waldman et al. | 5/430 |
| 7,775,228 | B2 | 8/2010 | Clark | |
| 7,862,122 | B1 | 1/2011 | Shammas | |
| 2007/0089242 | A1 * | 4/2007 | Battiston | 5/662 |
| 2010/0078052 | A1 * | 4/2010 | Clark | 135/65 |

OTHER PUBLICATIONS

The Wright Stuff, Arthritis Supplies, Assist-A-Tray, accessed by internet Apr. 23, 2014 at http://www.arthritissupplies.com/assist-a-tray-lap-desk-standing-aid.html.

The Wright Stuff, Arthritis Supplies, Standers Stable Rail, accessed by internet Apr. 23, 2014 at http://arthritissupplies.com/stable-rail.html.

The Wright Stuff, Arthritis Supplies, Smart-Rail System Bed Rail, accessed by internet Apr. 23, 2014 at http://www.arthritissupplies.com/smart-rail-system-bed-rail.html.

* cited by examiner

UNIVERSAL STAND ASSISTANCE DEVICES, KITS THEREFOR, AND METHODS RELATED THERETO

TECHNICAL FIELD

The present disclosure relates generally to mobility assistance devices. More specifically, the present disclosure relates to universal stand assistance devices, kits therefore, and methods related thereto.

BRIEF DESCRIPTION OF THE DRAWINGS

The embodiments disclosed herein will become more fully apparent from the following description and appended claims, taken in conjunction with the accompanying drawings. The drawings depict primarily generalized embodiments, which will be described with additional specificity and detail in connection with the drawings in which:

DETAILED DESCRIPTION

Figure 1:
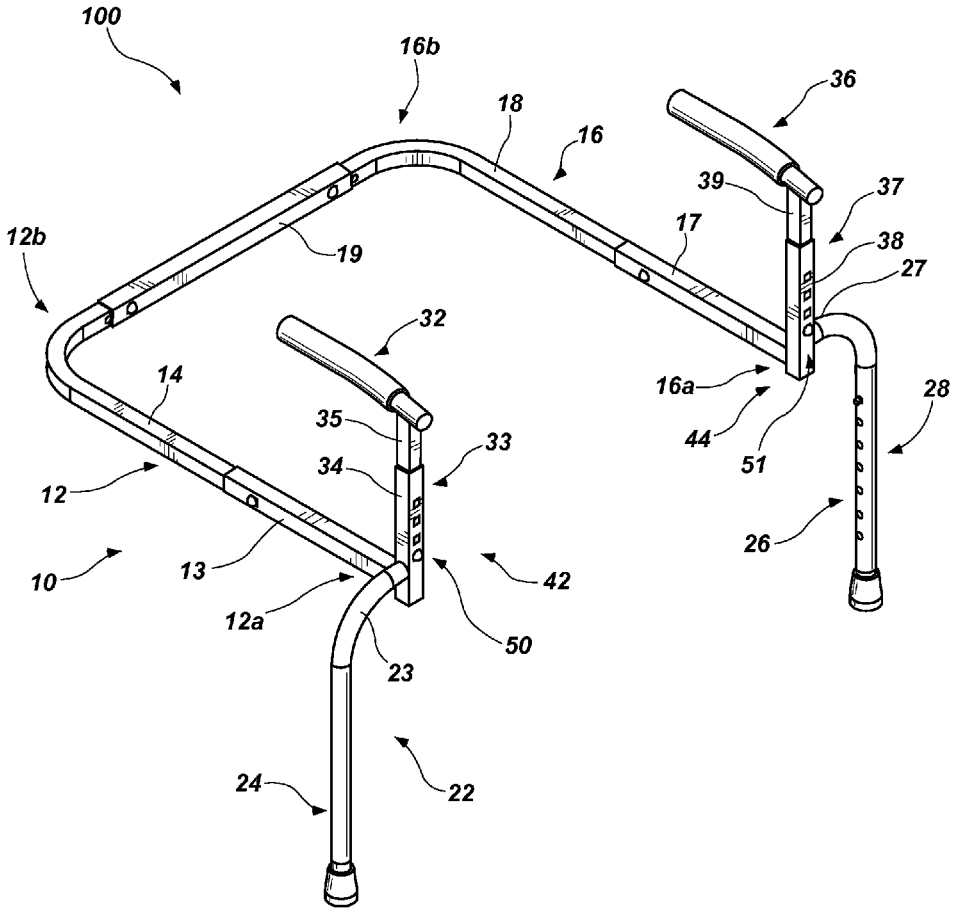
FIG. 1 illustrates an assembled perspective view of one embodiment of a stand assistance device.

Universal stand assistance devices, kits therefor, and methods related thereto are disclosed herein. It will be readily understood that the components of the embodiments as generally described below and illustrated in the figures herein could be arranged and designed in a wide variety of different configurations. Thus, the following more detailed description of various embodiments, as described below and represented in the figures, is not intended to limit the scope of the disclosure but is merely representative of various embodiments. While the various aspects of the embodiments are presented in drawings, the drawings are not necessarily drawn to scale unless specifically indicated.

The phrases "operably connected to," "connected to," and "coupled to" refer to any form of interaction between two or more entities, including mechanical, electrical, magnetic, electromagnetic, fluid, and thermal interaction. Two entities may interact with each other even though they are not in direct contact with each other. For example, two entities may interact with each other through an intermediate entity, unless specified as directly interacting.

In some embodiments of a stand assistance device, the device comprises an anchor comprising a first arm and a second arm. Each of the first and second arms may comprise a proximal end and a distal end. The length of each of the first and second arms may be adjustable. A first leg may be coupled to the proximal end of the first arm. A second leg may be coupled to the proximal end of the second arm. The height of each of the first and second legs may be adjustable. A first handle may be coupled to the proximal end of the first arm. A second handle may be coupled to the proximal end of the second arm. The height of each of the first and second handles may be adjustable.

In some embodiments of a kit for a stand assistance device, the kit comprises a first leg comprising a straight portion that may be adjustable in length. The first leg may be coupled to a first joint comprising a first horizontal member and a first vertical member. The straight portion of the first leg may extend perpendicular to the first horizontal member of the first joint and may extend parallel and opposite to the first vertical member of the first joint. The first horizontal member may comprise a portion of a first arm of an anchor.

The kit may further comprise a second leg comprising a straight portion that may be adjustable in length. The second leg may be coupled to a second joint comprising a second horizontal member and a second vertical member. The straight portion of the second leg may extend perpendicular to the second horizontal member of the second joint and may extend parallel and opposite to the second vertical member of the second joint. The second horizontal member may comprise a portion of a second arm of the anchor.

The kit may further comprise a first handle configured to be coupled to the first vertical member of the first joint. The kit may also further comprise a second handle configured to be coupled to the second vertical member of the second joint.

In some embodiments of a method of installing a stand assistance device, the method comprises selecting a depth and a width of a U-shaped anchor of a stand assistance device. The method may further comprise placing the U-shaped anchor around the sides and back of a cushion or underneath the cushion of a chair or couch. The method may further comprise adjusting a length of legs extending downwards from the U-shaped anchor so that ends of the legs rest firmly on a floor. The method may further comprise selecting a height of handles extending upwards from the U-shaped anchor.

The figures illustrate one embodiment of a stand assistance device 100. The stand assistance device 100 comprises various components and materials as further detailed below. Additionally, any combination of the individual components may comprise a kit for a stand assistance device.

FIG. 1 illustrates an assembled perspective view of the stand assistance device 100. In the illustrated embodiment, the stand assistance device 100 comprises an anchor 10. The anchor 10 comprises a first arm 12 and a second arm 16. The first arm 12 comprises a proximal end 12*a* and a distal end 12*b*. Likewise, the second arm 16 comprises a proximal end 16*a* and a distal end 16*b*. The length of the first arm 12 is adjustable, and the length of the second arm 16 is adjustable.

In the illustrated embodiment, a first leg 22 is coupled to the proximal end 12*a* of the first arm 12. A second leg 26 is coupled to the proximal end 16*a* of the second arm 16. The height of the first leg 22 is adjustable, and the height of the second leg 26 is adjustable.

In the illustrated embodiment, a first handle 32 is coupled to the proximal end 12*a* of the first arm 12. A second handle 36 is coupled to the proximal end 16*a* of the second arm 16.

The height of the first handle 32 is adjustable. The height of the second handle 36 is also adjustable.

In the illustrated embodiment, the first arm 12 is parallel to the second arm 16. Additionally, the distal end 12*a* of the first arm 12 is operably and adjustably connected to the distal end 16*a* of the second arm 16. In the illustrated embodiment, the first arm 12 is rigidly coupled to the second arm 16; however, the distance between the first arm 12 and the second arm 16 can be varied. In other embodiments, the first arm 12 may not be rigidly coupled to the second arm 16. In still other embodiments, the first arm 12 may be rigidly coupled to the second arm 16 and the distance between the two arms cannot be adjusted.

In the illustrated embodiment, the anchor 10 also comprises a coupling member 19 adjustably connected to the distal end 12*a* of the first arm 12 and adjustably connected to the distal end 16*a* of the second arm 16. The coupling member 19 is configured to vary the distance between the first arm 12 and the second arm 16. In the illustrated embodiment, the coupling member 19 is in the same plane as the first arm 12 and the second arm 16.

In the illustrated embodiment, the stand assistance device 100 further comprises a first upright arm 33 coupled to the proximal end 12*a* of the first arm 12. The stand assistance device 100 also further comprises a second upright arm 37 coupled to the proximal end 16*a* of the second arm 16. The first upright arm 33 is coupled to the first handle 32, and the second upright arm 37 is coupled to the second handle 36. The height of the first upright arm 33 is adjustable, and the height of the second upright arm 37 is also adjustable.

In the illustrated embodiment, the first upright arm 33 extends upwards from the proximal end 12*a* of the first arm 12 and the first leg 22 extends downwards from the proximal end 12*a* of the first arm 12. Likewise, the second upright arm 37 extends upwards from the proximal end 16*a* of the second arm 16 and the second leg 26 extends downwards from the proximal end 16*a* of the second arm 16.

In the illustrated embodiment, the first upright arm 33 is oriented perpendicular to the first arm 12 and the second upright arm 37 is oriented perpendicular to the second arm 16. Additionally, the first leg 22 is oriented perpendicular to the first arm 12 and the second leg 26 is oriented perpendicular to the second arm 16.

In the illustrated embodiment, the first leg 22 is outwardly offset from the proximal end 12*a* of the first arm 12 and the second leg 26 is outwardly offset from the proximal end 16*a* of the second arm 16, such that the distance between the first and second legs 22, 26 is wider than the distance between the first and second arms 12, 16 of the anchor 10. The first leg 22 comprises a curve portion 23 that offsets a straight portion 24 of the first leg 22 from the first upright arm 33 (and also from the proximal end 12*a*). The straight portion 24 is adjustable in length. Likewise, the second leg 26 comprises a curve portion 27 that offsets a straight portion 28 of the second leg 26 from the upright arm 37 (and also from the proximal end 16*a*). The straight portion 28 is adjustable in length.

In the illustrated embodiment, the first arm 12 comprises a first horizontal member 13 that includes the proximal end 12*a*. The first arm 12 also comprises a first arcuate member 14 adjustably connected to the first horizontal member 13. The first arcuate member 14 includes the distal end 12*b* of the first arm 12.

Likewise, in the illustrated embodiment, the second arm 16 comprises a second horizontal member 17 that includes the proximal end 16*a*. The second arm 16 also comprises a second arcuate member 18 adjustably connected to the second horizontal member 17. The second arcuate member 18 includes the distal end 16*b* of the second arm 16. In the illustrated embodiment, the distal end 12*b* of the first arcuate member 14 is adjustably connected to the coupling member 19 and the distal end 16*b* of the second arcuate member 18 is adjustably connected to the coupling member 19.

In the illustrated embodiment, the first upright arm 33 comprises a first vertical member 34 directly coupled to the proximal end 12*a* of the first horizontal member 13. The first handle 32 is adjustably coupled to the first vertical member 34. In the illustrated embodiment, the first handle 32 comprises a shank 35 adjustably coupled to the vertical member 34.

Likewise, in the illustrated embodiment, the second upright arm 37 comprises a second vertical member 38 directly coupled to the proximal end 16*a* of the second horizontal member 17. The second handle 36 is adjustably coupled to the second vertical member 38. The second handle 36 comprises a shank 39 adjustably coupled to the second vertical member 38.

In the illustrated embodiment, the first horizontal member 13, the first leg 22, and the first vertical member 34 comprise a first joint 42. Likewise, the second horizontal member 17, the second leg 26, and the second vertical member 38 comprise a second joint 44.

In the illustrated embodiment, the curve portion 23 of the first leg 22 is directly coupled to the first vertical member 34. Likewise, the curve portion 27 of the second leg 26 is directly coupled to the second vertical member 38.

In the illustrated embodiment, the anchor 10 has a U shape. In other embodiments, the anchor 10 may have other shapes.

Figure 2:
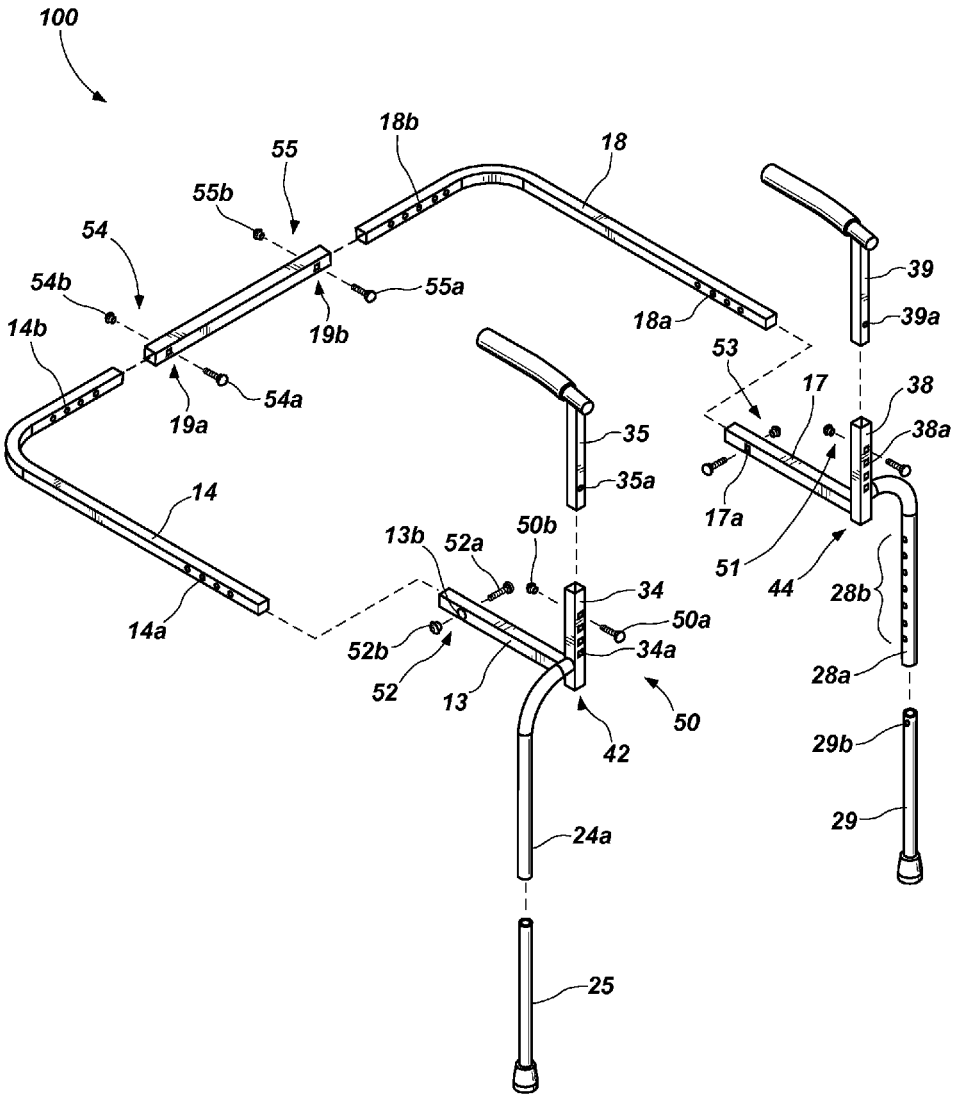
FIG. 2 illustrates an exploded view of the embodiment illustrated in FIG. 1.
Figure 3:
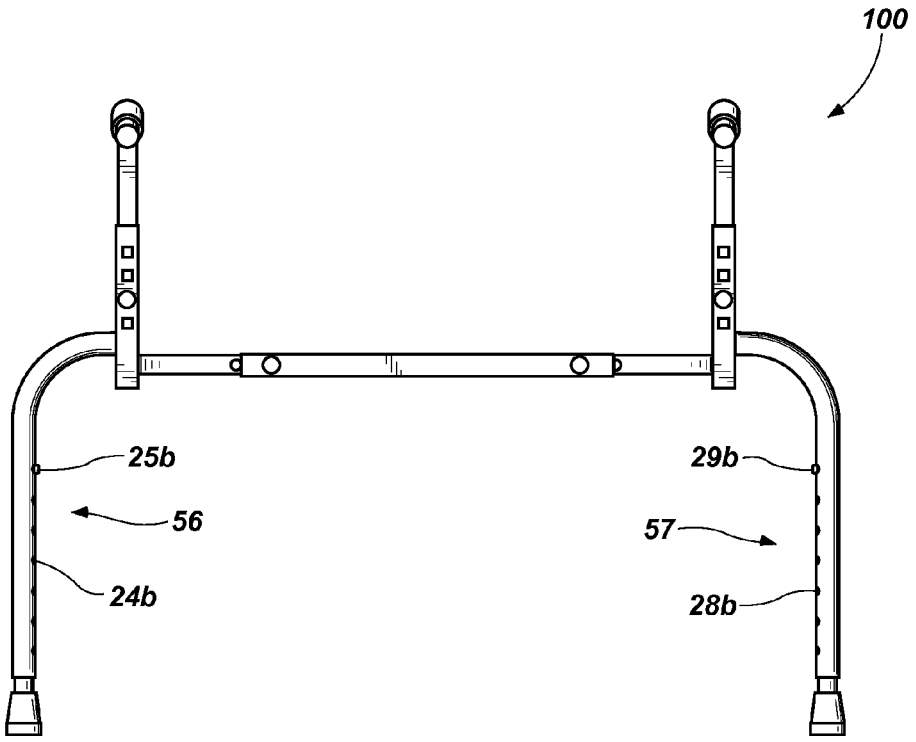
FIG. 3 illustrates a front view of the embodiment illustrated in FIG. 1.
Figure 4:
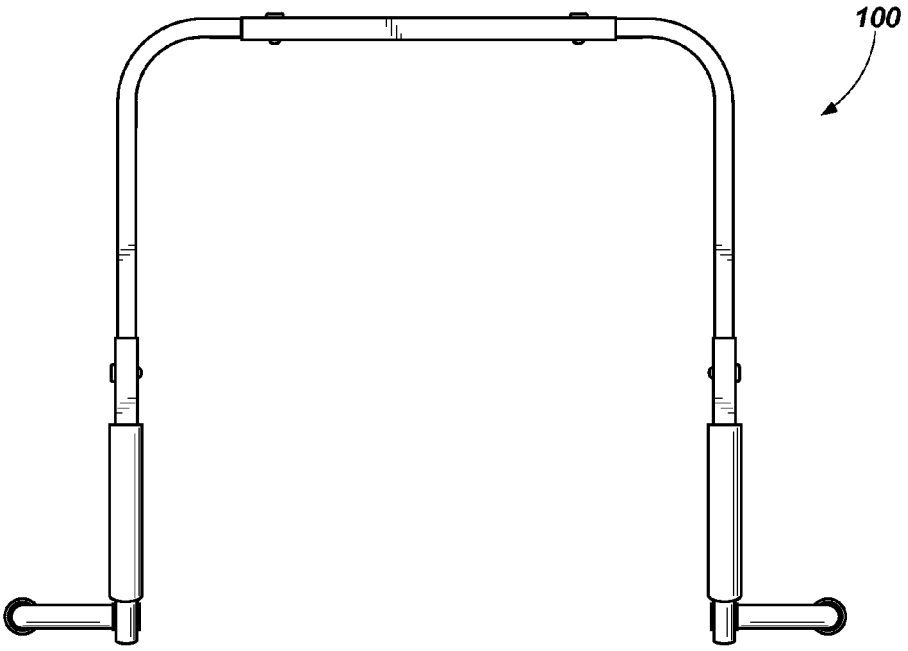
FIG. 4 illustrates a top view of the embodiment illustrated in FIG. 1.
Figure 5:
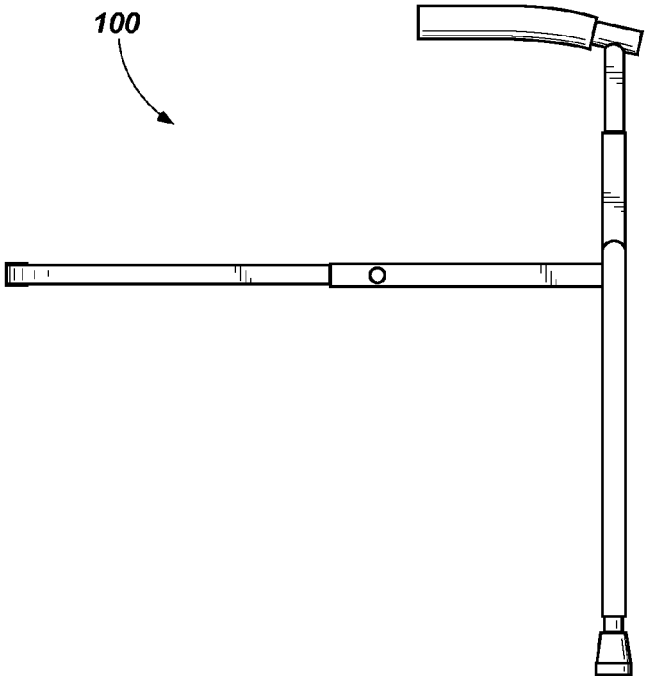
FIG. 5 illustrates a side view of the embodiment illustrated in FIG. 1.
Figure 6:
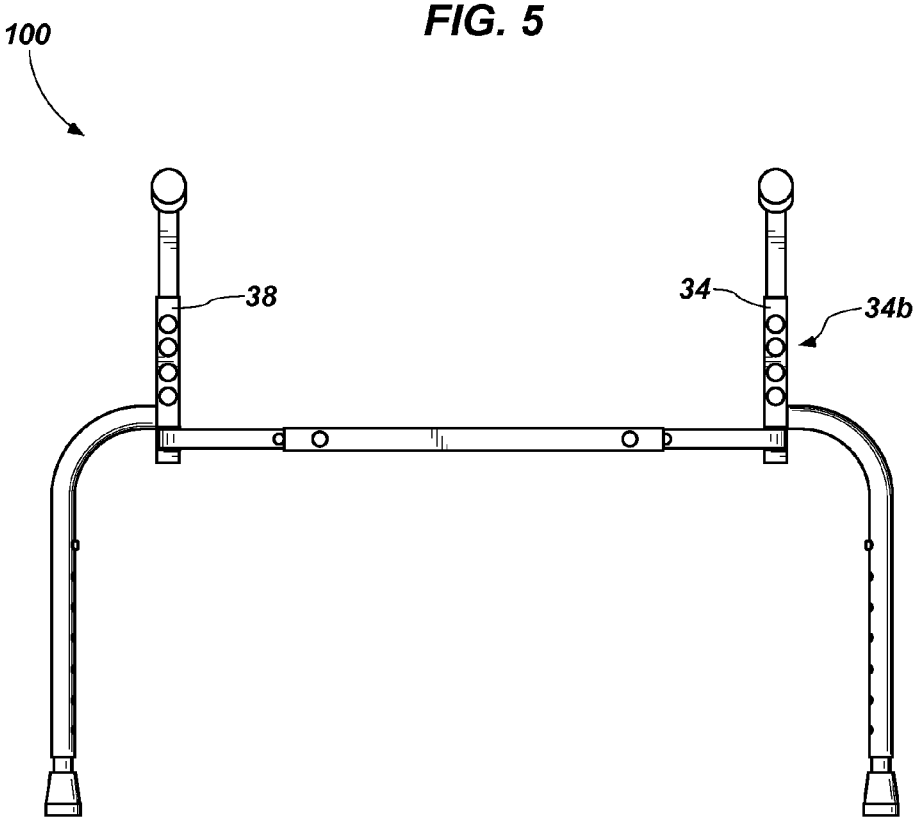
FIG. 6 illustrates a back view of the embodiment illustrated in FIG. 1.

FIG. 2 illustrates an exploded view of the stand assistance device 100 and further illustrates how the components of the stand assistance device 100 are connected. FIG. 3 illustrates a front view of the assembled stand assistance device 100. FIGS. 4-6 illustrates a top view, side view, and back view of the same, respectively.

In the illustrated embodiment, the first horizontal member 13 is configured to receive the long end of the first arcuate member 14. A fastener 52 is used to fix the first horizontal member 13 to the first arcuate member 14 at the selected length. The first horizontal member 13 comprises a single square hole 13*a* in the inner face (FIG. 9) and a corresponding round hole 13*b* in the outer face. Square hole 13*a* is configured to receive the square neck of a carriage bolt 52*a* of the fastener 52. The round hole in the inner face is configured for receiving a recessed nut 52*b* of the fastener 52. The long end of the first arcuate member 14 includes a series of round holes 14*a* for receiving the threaded portion of the carriage bolt 52*a*. The length of the first arm 12 is determined by which hole 14*a* is aligned with holes 13*a*, 13*b* to receive fastener 52. Likewise, the length of the second arm 16 is determined by which hole 18*a* of the long end of second arcuate member 18 is aligned with holes 17*a*, 17*b* to receive the fastener 53.

In the illustrated embodiment, one end of the coupling member 19 is configured to receive the short end of the first arcuate member 14 and the other end is configured to receive the short end of the second arcuate member 18. The coupling member 19 comprises a square hole 19*a* at one end of the front face and a square hole 19*b* at the other end of the front face. Corresponding single round holes 19*c* and 19*d* (FIG. 8) are formed at either end of the back face. The square hole 19*a* is configured to receive the square neck of a carriage bolt 54*a* of the fastener 54. The round hole 19*c* in the back face is configured for receiving a recessed nut 54*b* of the fastener 54. The short end of the first arcuate member 14 includes a series of round holes 14*b* for receiving the threaded portion of the carriage bolt 54*a*. The square hole 19*b* is configured to receive the square neck of a carriage bolt 55*a* of the fastener 55. The round hole 19*d* in the back face is configured for receiving a recessed nut 55*b* of the fastener 55. The short end of the first arcuate member 18 includes a series of round holes 18*b* for receiving the threaded portion of the carriage bolt 55*a*. The distance between the first and second arms 12,16 is determined by which hole 14*b* is aligned with holes 19*a*, 19*c* to receive fastener 54 and which hole 18*b* is aligned with holes 19*b*, 19*d* to receive fastener 55.

In the illustrated embodiment, the straight portion 24 of the first leg 22 comprises a fixed portion 24*a* and an adjustable portion 25. In the illustrated embodiment, the curve portion 23 is directly coupled to the fixed portion 24*a*. The fixed portion 24*a* is configured to receive the adjustable portion 25. Fastener 56 adjustably couples the adjustable portion 25 to the fixed portion 24*a*. In the illustrated embodiment, the fastener 56 comprises a biasable protrusion 25*b* located on an outer surface near the upper end of the adjustable portion 25 (FIG. 3). The fastener 56 also comprises a series of holes 24*b* (FIG. 3) formed in the fixed portion 24*a*. The fixed portion 24*a* includes a series of holes 24*b* (FIG. 3). The holes 24*b* are configured to receive the biasable protrusion 25*b*. The biasable protrusion 25*b* may comprise a rigid button fixed to a spring bar. The spring bar may be attached to an inner surface of the adjustable portion 25, and the rigid button may protrude through a hole in the outer surface of the adjustable portion 25. The length of the first leg 22 is determined by which hole 24*b* is engaged with the biasable protrusion 25*b*.

Likewise, in the illustrated embodiment, the straight portion 28 of the second leg 26 comprises a fixed portion 28*a* and an adjustable portion 29. In the illustrated embodiment, the curve portion 27 is directly coupled to the fixed portion 28*a*. The fixed portion 28*a* is configured to receive the adjustable portion 29. Fastener 57 adjustably couples the adjustable portion 29 to the fixed portion 28*a*. In the illustrated embodiment, the fastener 57 comprises a biasable protrusion 29*b* located on an outer surface near the upper end of the adjustable portion 29 (FIG. 2). The fastener 57 also comprises a series of holes 28*b* (FIG. 2) formed in the fixed portion 28*a*. The holes 28*b* are configured to receive the biasable protrusion 29*b*. The length of the second leg 26 is determined by which hole 28*b* is engaged with the biasable protrusion 29*b*.

In the illustrated embodiment, the first vertical member 34 is configured to receive the shank 35. A fastener 50 is used to fix the shank 35 to the first vertical member 34 at the selected height. The first vertical member 34 comprises a series of holes 34*a* in the front face and a series of holes 34*b* (FIG. 6) in the back face. In particular, holes 34*a* are square holes for receiving the square neck of a carriage bolt 50*a* (FIG. 2) of the fastener 50. Holes 34*b* are round holes for receiving a recessed nut 50*b* (FIG. 2) of the fastener 50. The shank 35 includes a single round hole 35*a* in the front and back faces for receiving the threaded portion of the carriage bolt 50*a*. Likewise, the second vertical member 38 is configured to receive the shank 39 and fastener 51 is used to fix the shank 39 to the second vertical member 38 at the selected height.

It should be understood that the illustrated embodiment is an exemplary embodiment. In the illustrated embodiment, fasteners 50-55 are interchangeable and do not have abrasive edges. Likewise, fasteners 56 and 57 do not have abrasive edges. In other embodiments, different fasteners that may or may not be interchangeable may be used. In some embodiments, fasteners with abrasive edges may be used. For example, hex head bolts could be used instead of carriage bolts in fasteners 50-55. In other examples, hex nuts, lock nuts, or wing nuts could be used instead of recessed nuts.

It should also be understood that numerous other variations to the illustrated embodiments are encompassed by this disclosure. In some embodiments, the first and second upright arms 33, 37 may not be perpendicular to the first and second arms 12, 16. In some embodiments, the first and second legs 22, 26 may not be perpendicular to the first and second arms 12, 16. In some embodiments, the first and second legs 22, 26 may not be outwardly offset. In some embodiments, the straight portion 24 may be offset from the first vertical member 34 by a structure other than the curve portion 23. Likewise, the straight portion 28 may be offset from the second vertical member 38 by a structure other than the curve portion 27.

Examples of other variations include that in some embodiments, the coupling member 19 may not be present, such as in embodiments where the first arm 12 is not coupled to the second arm 16. In the illustrated embodiment, the anchor 10 has a "square" cross-sectional shape. In other variations, the anchor 10 may have a round, an oval, or any other cross-sectional shape. Likewise, any component of the stand assistance device 100 may have cross-sectional shapes that differ from the cross-sectional shape in the illustrated embodiment.

The illustrated embodiment only shows exemplary components and mechanisms for adjusting the length of the first and second arms 12, 16, the first and second legs 22, 26, and the first and second handles 32, 36. In other embodiments, different ways and components for adjusting the length of the arms, legs, and handles may be used.

In some embodiments of a kit for the stand assistance device 100, the kit may comprise the first and second joints 42, 44. The kit may further comprise the first and second handles 32, 36. The kit may also further comprise the first and second arcuate members 14, 18 and the coupling member 19.

Figure 7:
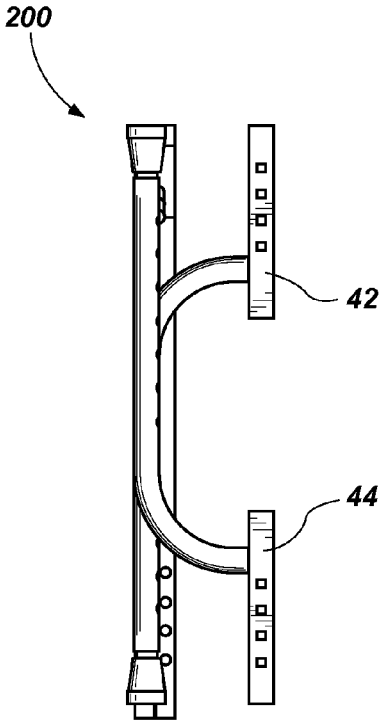
FIG. 7 illustrates a side view of one embodiment of an unassembled storage configuration of the embodiment illustrated in FIG. 1.
Figure 8:
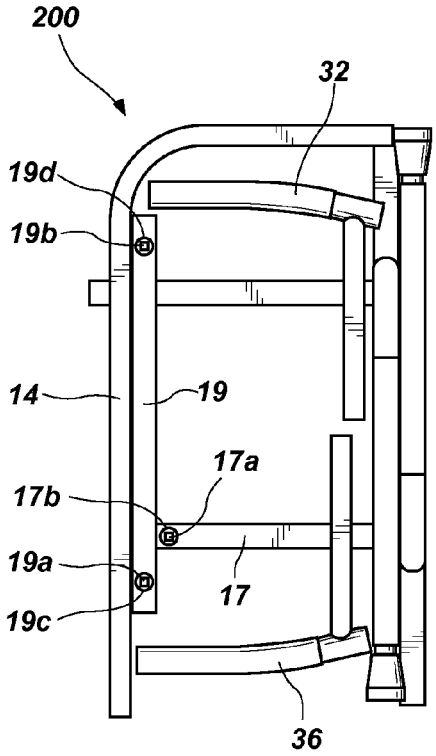
FIG. 8 illustrates an underside view of the unassembled storage configuration of FIG. 7.
Figure 9:
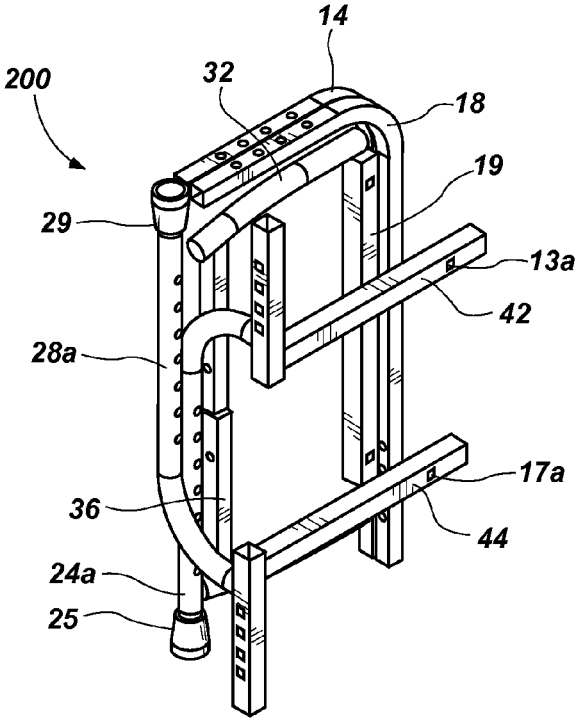
FIG. 9 illustrates a perspective view of the unassembled storage configuration of FIG. 7.

FIGS. 7-9 illustrate one embodiment of a kit 200 for the stand assistance device 100. FIG. 7 illustrates a side view of the kit 200 in one embodiment of an unassembled storage configuration. FIG. 8 illustrates an underside view of the same. FIG. 9 illustrates a perspective view of the same.

In the illustrated embodiment, the kit 200 comprises the first joint 42 and the second joint 44. The kit 200 further comprises the first and second arcuate members 14, 18 and the coupling member 19. The 200 also comprises the first and second handles 32, 36. In the illustrated embodiment, the first and second arcuate members 14, 18 are interchangeable. Likewise, in the illustrated embodiment, the first and second handles 32, 36 are also interchangeable.

In the illustrated embodiment of the kit 200, the biasable protrusions 25*b* and 29*b* are not visible, because they have been depressed and the adjustable portions 25 and 29 have been fully inserted, respectively, into the fixed portions 24*a* and 28*a*.

In the illustrated embodiment, the kit 200 may be packaged in a box having a length about equal to the length of the first and second arcuate members 14, 18, a width about equal to the width of the first and second arcuate members 14, 18, plus the diameter of the widest portion of the second leg 26, and a height about equal to the width of the first and second joints 42, 44.

Figure 10:
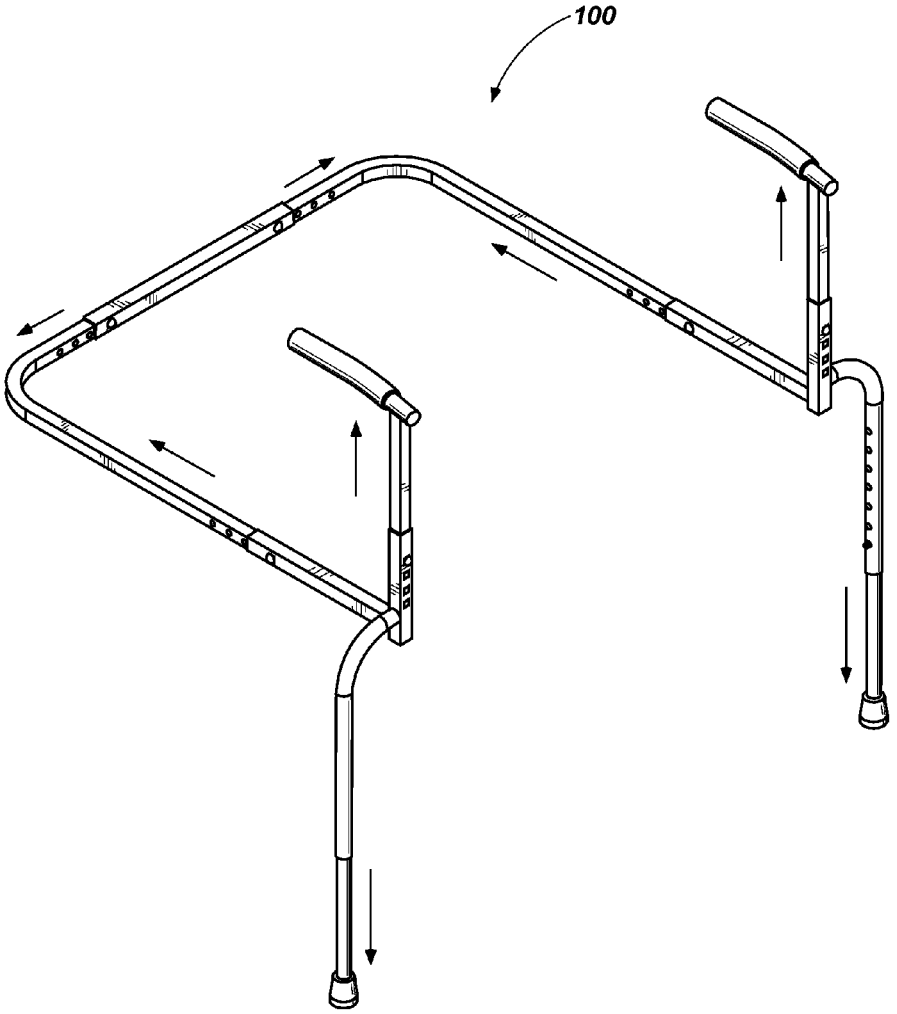
FIG. 10 illustrates an assembled view of the embodiment of FIG. 1 with each of the components fully extended.

FIG. 10 illustrates an assembled view of the stand assistance device 100 with the first and second arms 12, 16 fully extended, the distance between the first and second arms 12, 16 maximized, the first and second legs 22, 26 fully extended, and the first and second handles 32, 36 fully extended. It should be understood that the stand assistance device 100 may be configured any number of ways to fit various sizes of furniture.

In some embodiments of a method of installing the stand assistance device 100, the method comprises selecting a depth and a width of the anchor 10. The method may further comprise placing the anchor 10 around the sides and back of a cushion or underneath the cushion of a chair or couch. The method may further comprise adjusting the length of the first and second legs 22, 26 so that the ends of the legs rest firmly on the floor. The method may further comprise selecting a height of the first and second handles 32, 36.

Figure 11:
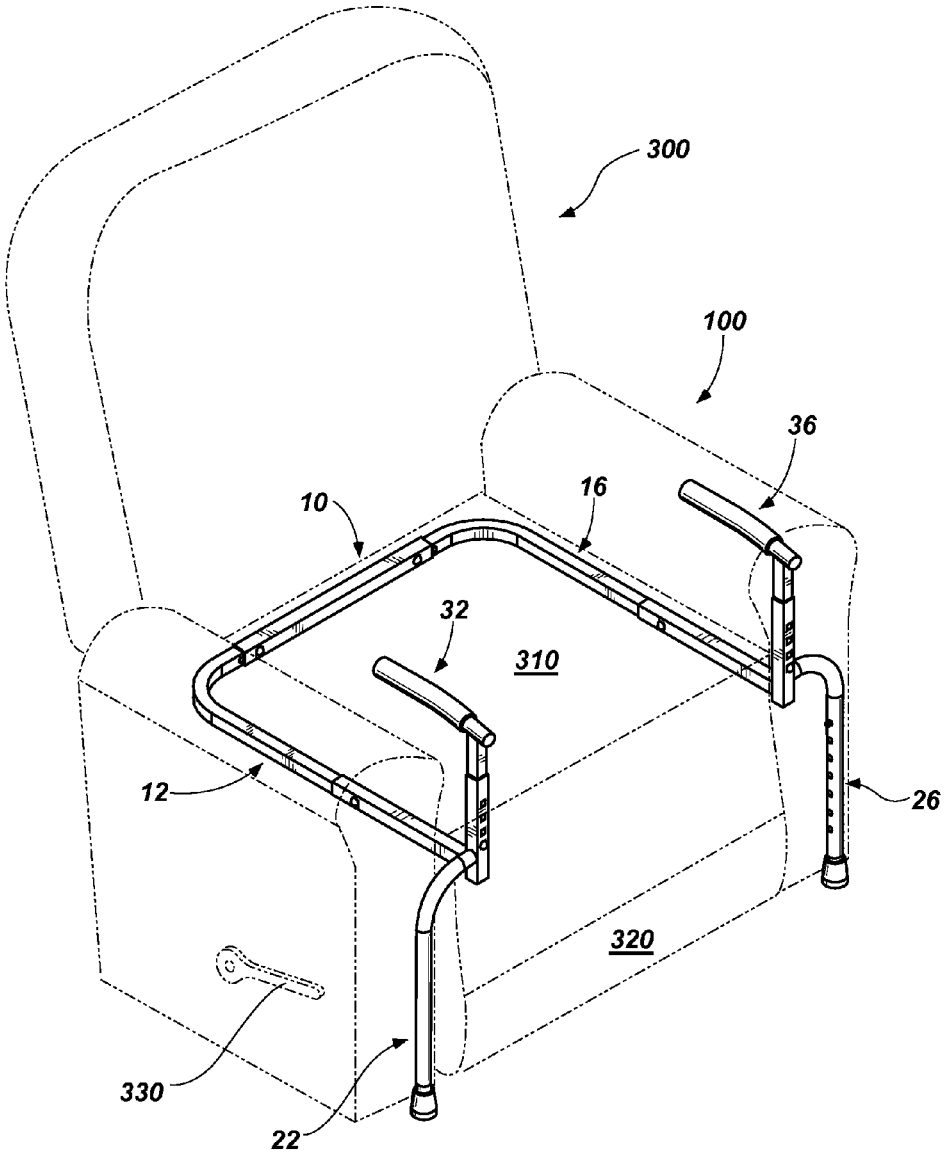
FIG. 11 illustrates the use of the embodiment of FIG. 1 with a recliner.

FIG. 11 illustrates the use of the stand assistance device 100 with a recliner 300. The recliner 300 comprises a cushion 310, a footrest 320, and an actuator 330. One of the benefits of the stand assistance device 100 is that the depth and width of the anchor 10 may be adjusted to fit the size of the cushion 310. As illustrated in FIG. 11, the anchor 10 can be sized to circumscribe the sides and back of the cushion 310. Once sized, the anchor 10 can then be placed around the cushion 310 and allowed to rest below the upper surface of the cushion 310. The length of the first and second legs 22, 26 may then be adjusted to rest upon the floor. The height of the first and second handles 32, 36 may also be adjusted to a desired height. Another benefit of the stand assistance device 100 is that it may be used with the recliner 300 even if the footrest 320 is wider than the cushion 310. This is because the distance between the first and second legs 22, 26 is wider than the distance between the first and second arms 12, 16 (i.e., the width of the anchor 10). However, the stand assistance device 100 may be used with furniture other than recliners.

Figure 12:
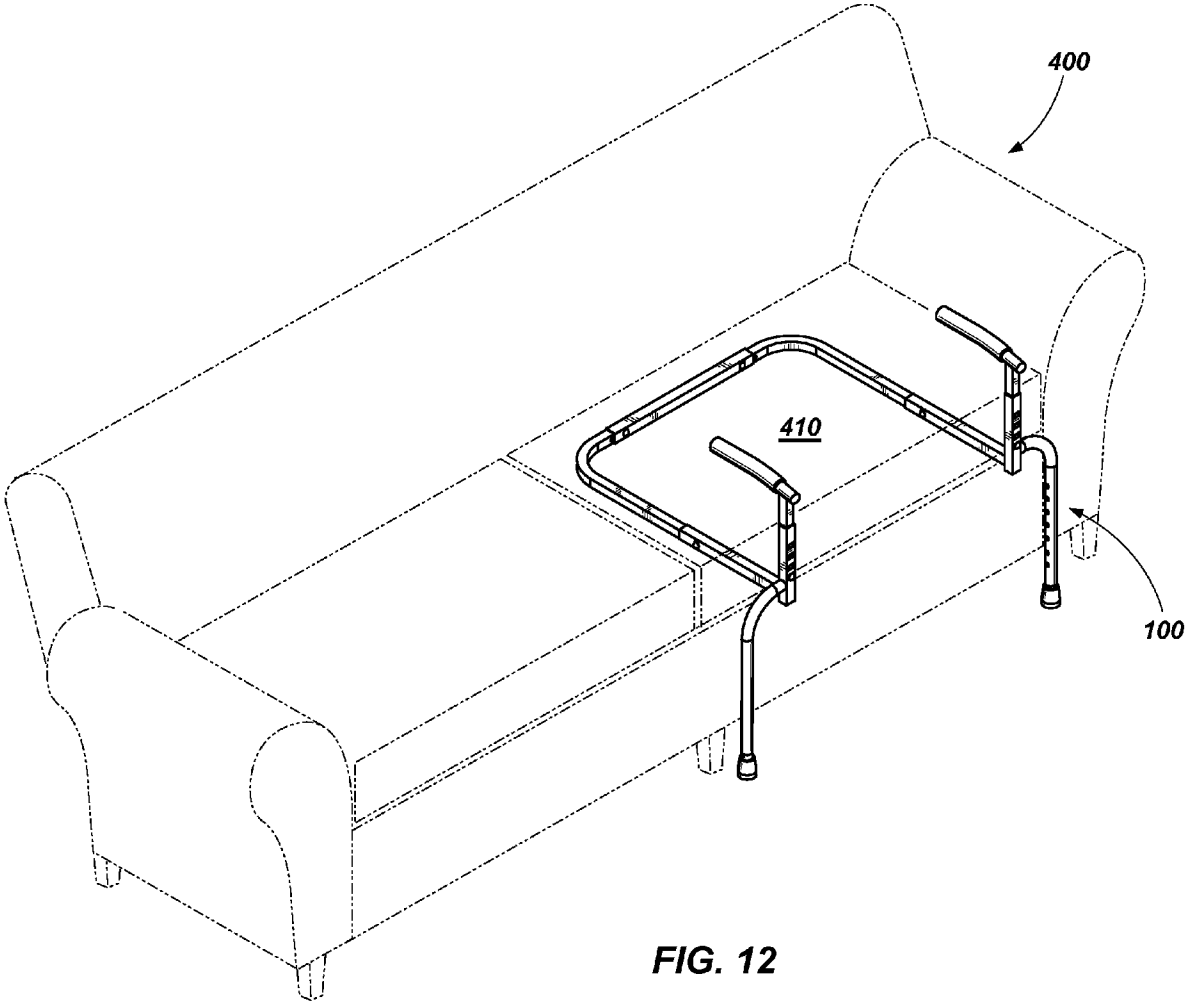
FIG. 12 illustrates the use of the embodiment of FIG. 1 with a couch.

FIG. 12 illustrates the use of the stand assistance device 100 with a couch 400. The couch 400 comprises a cushion 410. The depth of the anchor 10 may be adjusted so as to not exceed the depth of the cushion 410. As illustrated in FIG. 12, the anchor 10 may then be slid underneath the cushion 410 (or the cushion 410 may be removed, the anchor 10 put in place, and then the cushion 410 placed over the anchor 10). The length of the first and second legs 22, 26 may then be adjusted to rest upon the floor. The height of the first and second handles 32, 36 may also be adjusted to a desired height.

Without further elaboration, it is believed that one skilled in the art can use the preceding description to utilize the present disclosure to its fullest extent. The examples and embodiments disclosed herein are to be construed as merely illustrative and exemplary and not a limitation of the scope of the present disclosure in any way. It will be apparent to those having skill in the art, and having the benefit of this disclosure, that changes may be made to the details of the above-described embodiments without departing from the underlying principles of the disclosure herein.

The invention claimed is:

1. A stand assistance device comprising:

an anchor comprising a first arm, a second arm, and a coupling member, wherein each of the first and second arms comprises a proximal end and a distal end and wherein a length of each of the first and second arms is adjustable, and wherein the coupling member is the only member that couples the first arm and the second arm;

a first leg coupled to the proximal end of the first arm and a second leg coupled to the proximal end of the second arm, wherein a height of each of the first and second legs is adjustable, wherein there are no other legs than the first leg and the second leg; and a first handle coupled to the proximal end of the first arm and a separate second handle coupled to the proximal end of the second arm, wherein a height of each of the first and second handles is separately adjustable, wherein the height of the first handle is also separately adjustable from the height of the first leg and the height of the second handle is also separately adjustable from the height of the second leg.

2. The stand assistance device of claim 1, wherein the first arm is parallel to the second arm.

3. The stand assistance device of claim 1, wherein the distal end of the first arm is operably connected to the distal end of the second arm.

4. The stand assistance device of claim 3, wherein the distal end of the first arm is adjustably connected to the distal end of the second arm.

5. The stand assistance device of claim 1, wherein the coupling member is adjustably connected to the distal end of the first arm and adjustably connected to the distal end of the second arm, wherein the coupling member is configured to vary a distance between the first arm and the second arm.

6. The stand assistance device of claim 5, wherein the coupling member is in the same plane as the first and second arms.

7. The stand assistance device of claim 1, further comprising a first upright arm coupled to the proximal end of the first arm and a second upright arm coupled to the proximal end of the second arm, and wherein the first upright arm is coupled to the first handle and the second upright arm is coupled to the second handle.

8. The stand assistance device of claim 7, wherein the first upright arm is oriented perpendicular to the first arm and the second upright arm is oriented perpendicular to the second arm.

9. The stand assistance device of claim 7, wherein a height of each of the first and second upright arms is adjustable.

10. The stand assistance device of claim 7, wherein the first upright arm extends upwards from the proximal end of the first arm and the first leg extends downwards from the proximal end of the first arm and wherein the second upright arm extends upwards from the proximal end of the second arm and the second leg extends downwards from the proximal end of the second arm.

11. The stand assistance device of claim 1, wherein the first leg is oriented perpendicular to the first arm and the second leg is oriented perpendicular to the second arm.

12. The stand assistance device of claim 1, wherein an axis of the first leg is outwardly offset from an axis of the first handle and an axis of the second leg is outwardly offset from an axis of the second handle.

13. The stand assistance device of claim 1, wherein the coupling member is adjustably connected to the distal end of the first arm and adjustably connected to the distal end of the second arm, wherein the coupling member is configured to vary a distance between the first arm and the second arm, wherein the first and second arms and the coupling member are in the same plane as each other, wherein the first leg is oriented perpendicular to the first arm and the second leg is oriented perpendicular to the second arm, wherein the first leg is outwardly offset from the proximal end of the first arm and the second leg is outwardly offset from the proximal end of the second arm; and further comprising a first upright arm coupled to the proximal end of the first arm and a second upright arm coupled to the proximal end of the second arm, and wherein the first upright arm is coupled to the first handle and the second upright arm is coupled to the second handle, wherein the first upright arm is oriented perpendicular to the first arm and the second upright arm is oriented perpendicular to the second arm, wherein a height of each of the first and second upright arms is adjustable, wherein the first upright arm extends upwards from the proximal end of the first arm and the first leg extends downwards from the proximal end of the first arm and wherein the second upright arm extends upwards from the proximal end of the second arm and the second leg extends downwards from the proximal end of the second arm.

14. A kit for a stand assistance device comprising:

a first joint comprising a first horizontal member and a first vertical member, wherein the first horizontal member comprises a portion of a first arm of an anchor;

a first leg comprising a straight portion adjustable in length, wherein the first leg is coupled to the first joint, wherein the straight portion of the first leg extends perpendicular to the first horizontal member of the first joint and extends parallel and opposite to the first vertical member of the first joint, wherein the first leg in its shortest adjustment is longer than the first vertical member of the first joint;

a second joint comprising a second horizontal member and a second vertical member, wherein the second horizontal member comprises a portion of a second arm of the anchor;

a second leg comprising a straight portion adjustable in length, wherein the second leg is coupled to the second joint, wherein the straight portion of the second leg extends perpendicular to the second horizontal member of the second joint and extends parallel and opposite to the second vertical member of the second joint, wherein the second leg in its shortest adjustment is longer than the second vertical member of the second joint, wherein there are no other legs than the first leg and the second leg;

a first handle configured to be adjustably coupled to the vertical member of the first joint;

a separate second handle configured to be coupled to the vertical member of the second joint;

a first arcuate member configured to be adjustably connected to the horizontal member of the first joint and when connected to form a portion of the first arm of the anchor; and a second arcuate member configured to be adjustably connected to the horizontal member of the second joint and when connected to form a portion of the second arm of the anchor.

15. The kit of claim 14, wherein the first leg comprises a curve portion that offsets the straight portion of the first leg from the first vertical member of the first joint and the second leg comprises a curve portion that offsets the straight portion of the second leg from the second vertical member of the second joint.

16. The kit of claim 14, wherein second handle is configured to be adjustably coupled to the second vertical member of the second joint.

17. The kit of claim 14, further comprising a coupling member configured to be adjustably connected to the first arcuate member and adjustably connected to the second arcuate member and when connected to form a portion of the anchor.

18. The kit of claim 14, wherein the first handle comprises a shank configured to be adjustably coupled to the vertical member of the first joint and wherein the second handle comprises a shank configured to be adjustably coupled to the vertical member of the second joint.

19. A method of installing a stand assistance device, the method comprising:

selecting a depth and a width at the time of installation of a U-shaped anchor of a stand assistance device, wherein arms of the U-shaped anchor only connect to each other, directly or indirectly, via a single coupling member;

placing the U-shaped anchor around the sides and back of a cushion or underneath the cushion of a chair or couch;

adjusting a length of legs extending downwards from the U-shaped anchor so that ends of the legs rest firmly on a floor; and selecting separately a height of handles extending upwards from the U-shaped anchor.

20. The method of claim 19, wherein placing the U-shaped anchor around the sides and back of the cushion comprises recessing the U-shaped anchor below the upper surface of the cushion.

21. The method of claim 19, wherein the cushion comprises a recliner cushion.

22. The method of claim 21, wherein a distance between axes of the legs is greater than a distance between axes of the handles, such that a footrest of the recliner is capable of being extended and retracted without impinging on the legs of the stand assistance device.

23. The method of claim 19, wherein the height of the handles is selected so as to be similar to a height of an arm of the chair or couch.

* * * * *